US005152027A

United States Patent [19]

La Boda

[11] Patent Number: 5,152,027

[45] Date of Patent: Oct. 6, 1992

[54] INDUSTRIAL SWEEPER

[75] Inventor: John A. La Boda, Fairview Park, Ohio

[73] Assignee: Shop-Vac Corporation, Williamsport, Pa.

[21] Appl. No.: 503,457

[22] Filed: Apr. 2, 1990

[51] Int. Cl.[5] ..... A47L 11/24

[52] U.S. Cl. ..... 15/83; 15/503; 15/79.2; 15/340.4

[58] Field of Search ..... 15/50.3, 52.1, 79.2, 15/82-86, 179, 183, 340.1-340.4

[56] References Cited

U.S. PATENT DOCUMENTS

| | | | |
|---|---|---|---|
| 3,284,830 | 11/1966 | Kroll | 15/52.1 |
| 3,614,801 | 10/1971 | Peabody | 15/179 |
| 3,820,186 | 6/1974 | Peabody | 15/182 |
| 3,833,961 | 9/1974 | Fortman et al. | 15/50.3 |
| 3,892,003 | 7/1975 | Peabody | 15/340.3 X |
| 3,892,008 | 7/1975 | Christensen et al. | 15/340.3 |
| 3,921,373 | 11/1975 | Rubin | 15/79.2 |
| 3,979,789 | 9/1976 | Peabody et al. | 15/340.3 |
| 4,165,551 | 8/1979 | Rosseau | 15/179 |

*Primary Examiner*—Edward L. Roberts

*Attorney, Agent, or Firm*—Ostrolenk, Faber, Gerg & Soffen

[57] ABSTRACT

A surface sweeper may include a first pulley driven by the motor, a second pulley on a drive shaft for driving the drive wheel, a third pulley for driving the main brush, and a drive belt interconnecting the first and second pulleys which can be selectively tightened by a clutch for driving the drive wheel. Preferably the drive belt has inherent stiffness whereby it spontaneously loosens unless held in its tightened condition by the clutch. The driveshaft advantageously has two parts separated by a gap, for permitting the drive belt to be placed around the driveshaft without removing the driveshaft from its mount. The two parts may be connected by a sleeve which is biased by a spring into position for drivingly engaging the two parts, and which is slidable out of said position for revealing the gap. The main brush may have structures at its two ends that are similar to each other, for being reversibly mountable in first and second brush bearings. One of the brush bearings may include a structure upon which the main brush can pivot into and out of operating position, the other brush bearing having a lock for locking the main brush in its operating position.

26 Claims, 12 Drawing Sheets

FIG. 9
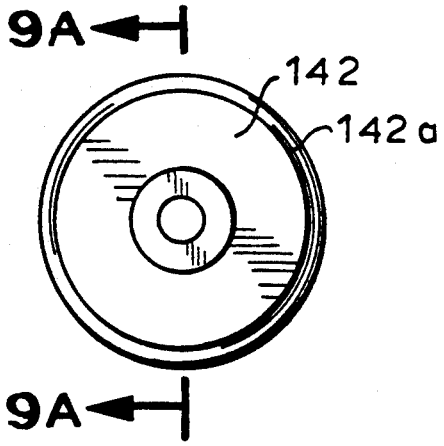
FIG. 9A
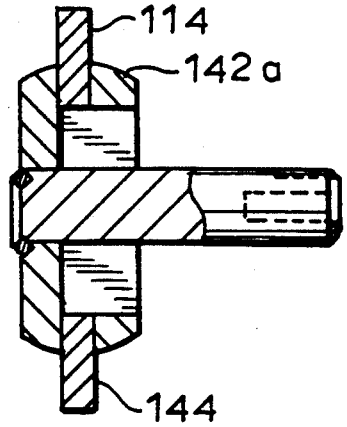
FIG. 12
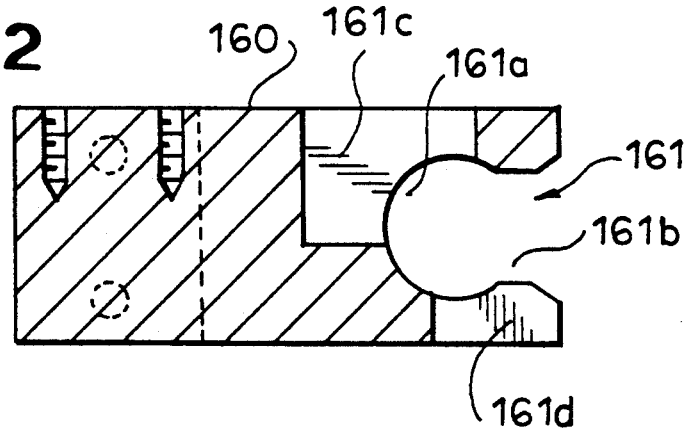
FIG. 12A
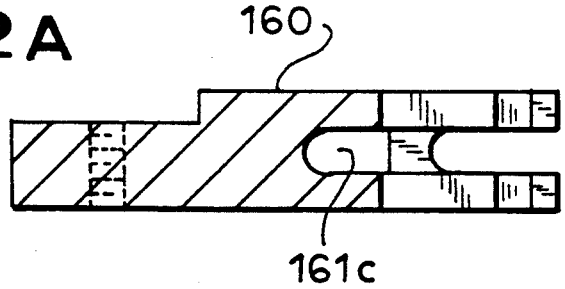
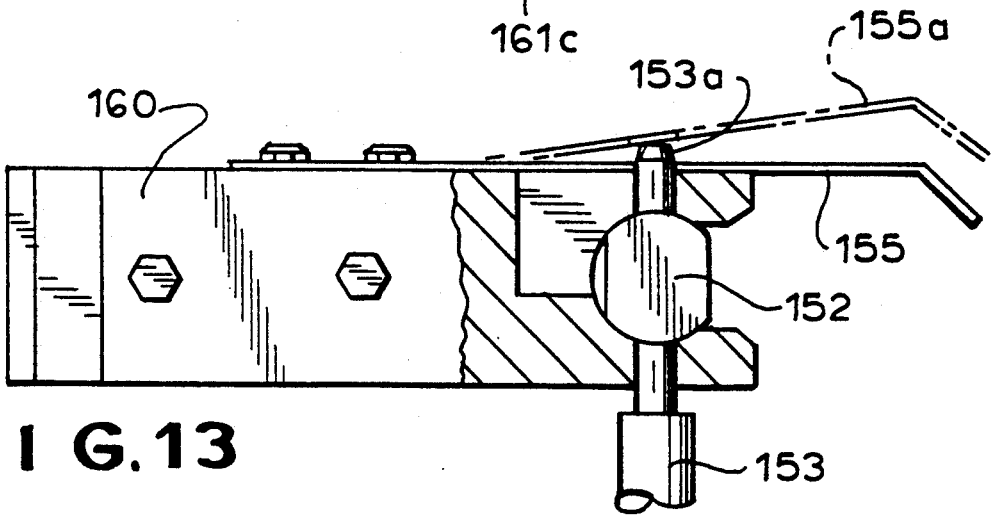
FIG. 13

FIG. 10
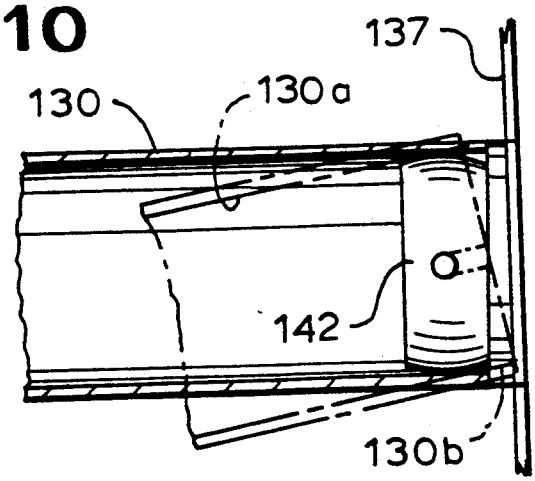
FIG. 11
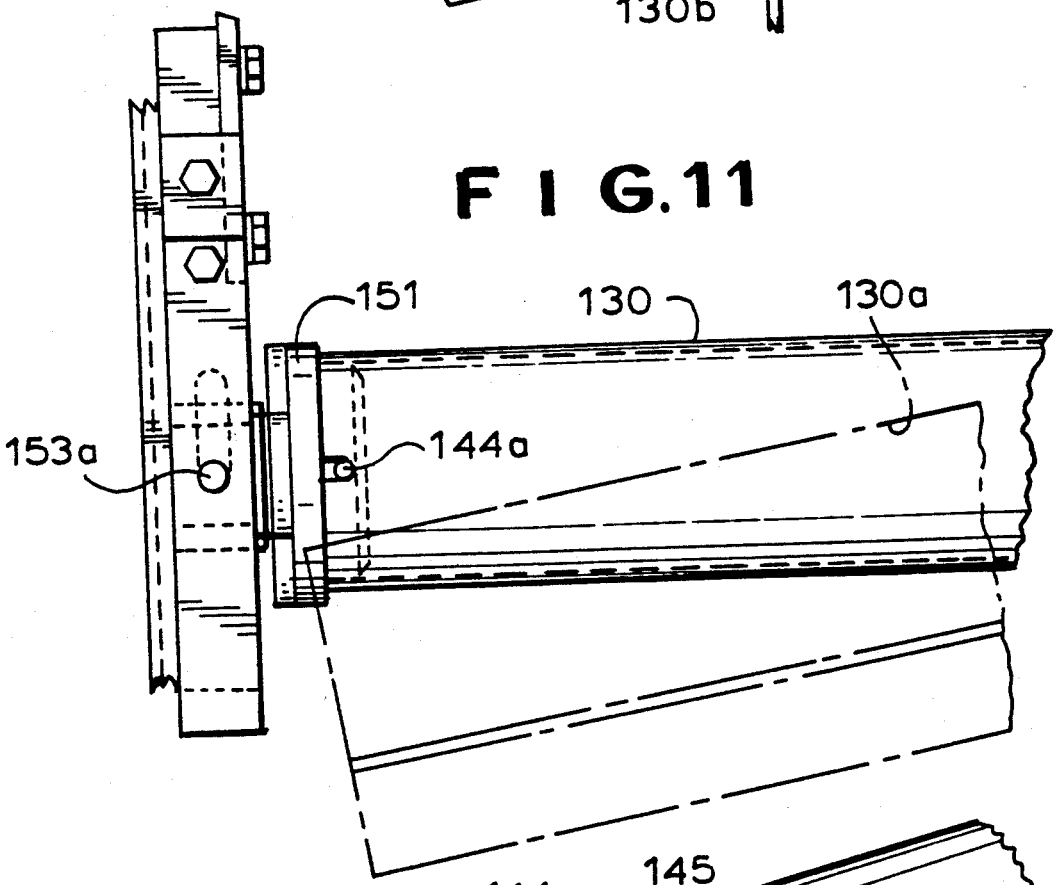
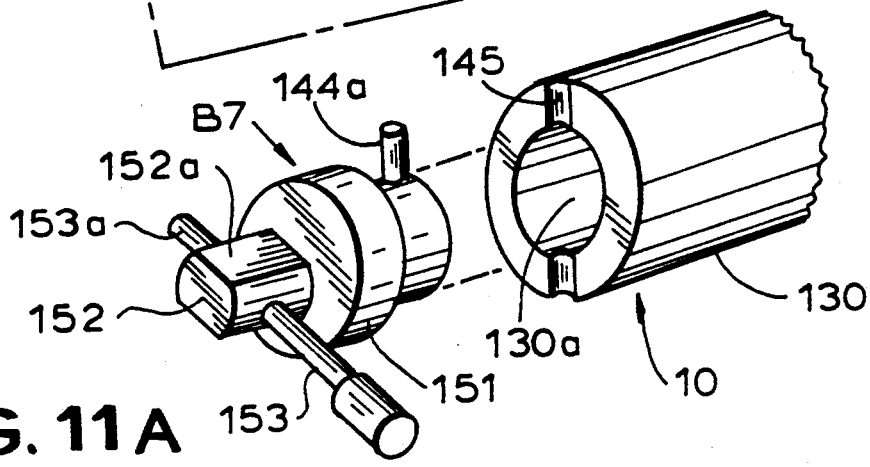
FIG. 11A

INDUSTRIAL SWEEPER

BACKGROUND OF THE INVENTION

The present invention relates to an industrial sweeper, and more particularly a sweeper which has improved features related to the mounting of the main brush, the power train and its controls, and other improvements.

Known industrial sweepers typically have an electrical or internal combustion motor; a main brush for sweeping all across the movement path of the sweeper; a side or front brush for sweeping debris from one side, into the path of the main brush; an air blower and filter system for handling dust; a drive wheel; and a power train for powering and controlling the drive wheel and brushes.

These known sweepers have several disadvantages. For example, the brushes and fan impeller may be driven continuously, even when the sweeper is stopped Or the sweeper may have a heavy or complex clutch arrangement. Both these features waste energy.

Another disadvantage of the prior sweepers is that the main brush is difficult to remove and replace. When the main brush becomes worn from rotating in one direction, it might still be usable if it were reversed and used in the opposite direction, but this cannot be accomplished in known sweepers.

Furthermore, the power trains of prior sweepers are complicated and belt replacement and maintenance are difficult.

SUMMARY OF THE INVENTION

The central object of the invention is to remedy the disadvantages mentioned above.

According to one important feature of the invention, the sweeper has a clutchable drive The drive to both the brush and the central single drive wheel is accomplished by a drive pulley on the main drive shaft which is driven by a clutchable V-belt. The clutch pulley is a shiftable idler that is shifted by the operation of a hand grip to tighten the drive belt both around the drive pulley that is driven by the motor, and around the pulley on the drive shaft.

The drive pulley that is driven by the motor is a double pulley spaced a short distance away on a shaft. One of the two pulleys of this double pulley serves as the drive pulley for the driving V-belt as just mentioned. The second of the two pulleys continuously drives the fan impeller The clutch pulley tightens the V-belt on the driving pulley of this double pulley, and on the driven pulley on the drive shaft, thereby driving the main drive shaft.

The use of a V-belt is advantageous because of its inherent stiffness. When the tension applied by the clutch pulley is relaxed, the V-belt tends to restore itself to a rounded or straightened condition, thereby lifting off the driving and driven pulleys. When the clutch pulley tightens down, it tightens the V-belt into the grooves of its two supporting pulleys on the motor and on the driveshaft, thereby driving the main shaft. A suitable retainer keeps the V-belt in position when it is loosened.

The main shaft drives the rear wheel via a flat poly-V belt which communicates continuously with the wheel.

The clutch pulley is on a crank arm which is centered and pivoted near or around the main shaft. When the clutch lever is operated, a cable connection pulls the crank arm which swings the clutch pulley against the V-belt to tighten it on the two pulleys (on the motor and on the drive shaft) that receive it.

The brushes are also driven off that same main drive shaft. The main brush has a pulley on its end and the drive shaft has a pulley on its end and a permanently attached belt communicates between the two pulleys. When the drive shaft is driven, it rotates the brush.

Thus, the single drive shaft advantageously drives both the brushes and the drive wheel, and the drive to the drive shaft is conveniently controlled by the simple clutch pulley arrangement. Thus the brushes are not driven when the sweeper is not moving, so energy is not wasted.

To replace the drive belt, it is necessary to get the drive belt around both the drive shaft and its main drive pulley, on which the belt is trained. To avoid having to remove the main drive shaft (which was necessary with prior sweepers) the main drive shaft is constructed as a split shaft, comprising two shaft parts and a sleeve that is sprung to be biased into a position joining the two parts of the split shaft. To separate the shaft, the sleeve is moved axially, opening the gap between the two sections of the split shaft and thereby permitting the belt to be removed through that gap. There may be at least one pin on each shaft part engaging the sleeve The shiftable sleeve makes it possible to remove the belt without having to remove any bearings or parts of the shaft from their mountings.

The brush is easily removable for any purpose, such as cleaning or replacement, by a highly useful mounting At a first end of the brush is a removable first bearing unit which is removably attached to the sweeper frame at that first end of the brush, and the brush is mounted to it for rotating. The first bearing unit, in turn, is easily insertable into a slot in the frame, is shaped to engage with the slot, and is locked into the slot by a spring clip.

At the opposite second end of the brush there is a permanent bearing fixture fixed in the sweeper frame. That bearing fixture has a partial spherical periphery, so that when the first end of the brush is extracted from the unit by removing its removable bearing unit from the slot, the second end of the brush can rotate around the radius of the rounded bearing section, or simply slide off. A pin and keyway arrangement connects the second end of the brush and the second bearing unit so that the two will rotate together.

These brush mounting features are significant, in that in conventional sweepers enough space must be provided inside the housing so that the brush can be shifted laterally sufficiently to free it from the mounting at the end. The invention avoids that by permitting the brush to be swiveled out, around the bearing unit at its second end, around the spherical engagement surface, until it has cleared the mounting at its first end.

The bearing unit at the first end is locked in by a highly advantageous locking arrangement It has a round shaft with two flats formed on it. The flats are able to fit into the entrance part of the slot which have flatted sides and this orients the bearing unit. At the rear, the slot is circular so that the circular radii on the bearing mounting shaft enable it to be rotated by a locking pin to an orientation that locks it in the slot against moving toward the front or rear of the sweeper (horizontally). Further, part of the locking pin projects from the bearing unit, into a spring clip mounted on the bearing unit receiver that prevents the shaft from rotating.

The spring clip or safety release must be operated to remove the bearing unit With the bearing unit rotated to the orientation where the rounded sides of the bearing unit lock in the round part of the slot, there is no possibility of removal. The slot may be formed in the spring clip itself, according to another feature of the invention.

Further, the bearing units at both ends have means for receiving the brush that are similar at both ends of the brush, so the brush may be symmetrical. The brush can be installed in either direction, making installation simpler, and allowing the brush mounting direction to be reversed as needed.

The brush drive arrangement causes the brush to rotate forward at the floor surface. There is a hopper at the front of the unit and the brush kicks dirt forward into the hopper at the front of the unit.

The hopper at the front has a multi-fingered strip which projects down toward the ground so that as the unit is moved forward, the fingers are separate and individually are flexible to permit the strip to pass over the ground. The strip elements on the surface provide the entrance pathway for dirt traveling into the hopper when it is pushed in that direction by the brush.

Because the rotating brush generates considerable dust, a dust removal unit is associated with it. At the top of the brush housing is a suction inlet which communicates with a space in the large flat filter housing, to the rear of the filter. A large rectangular filter in the filter housing filters the air which passes through it forwardly. At the front of the filter housing is a vacuum passageway which communicates with the impeller. The filtered air passes through the impeller and is blown down through the outlet. The motor drive pulley for the impeller is on a shaft that is driven constantly by the rotating motor.

The side (front) brush is connected with the main drive shaft through a pulley on the main drive shaft, which drives a first parallel pulley located down the arm toward the side brush. The first vertical parallel pulley is on a shaft and thereby drives a second vertical parallel pulley on the same shaft on the arm of the side brush. The second parallel pulley communicates with two horizontal pulleys and an O-ring belt (which is twistable) which rotates the plane of the belt by 90° into the proper horizontal orientation for driving the side brush.

Other features and advantages of the present invention will become apparent from the following description of preferred embodiments of the invention, with reference to the accompanying drawings.

BRIEF DESCRIPTION OF THE DRAWINGS

FIGS. 9 and 9A are respectively an end view and a cross-sectional view of a mandrel for supporting the second end of the main brush;

FIG. 10 is a schematic top view showing the main brush core, in its operating position and in a position for being removed from its mandrel at the second end of the brush core;

FIG. 11 is a schematic top view showing the first end of the brush core in its operating position and in a position in which it is being mounted on its support arrangement;

FIG. 11A is a perspective view showing a mandrel for mounting the first end of the main brush core on its support;

FIGS. 12 and 12A are respectively vertical and horizontal cross-sections of a bail arm extension which is part of the main brush support;

FIG. 13 is a side view, partly in cross-section, illustrating the mounting of the first and of the main brush;

DETAILED DESCRIPTION

Figure 1:
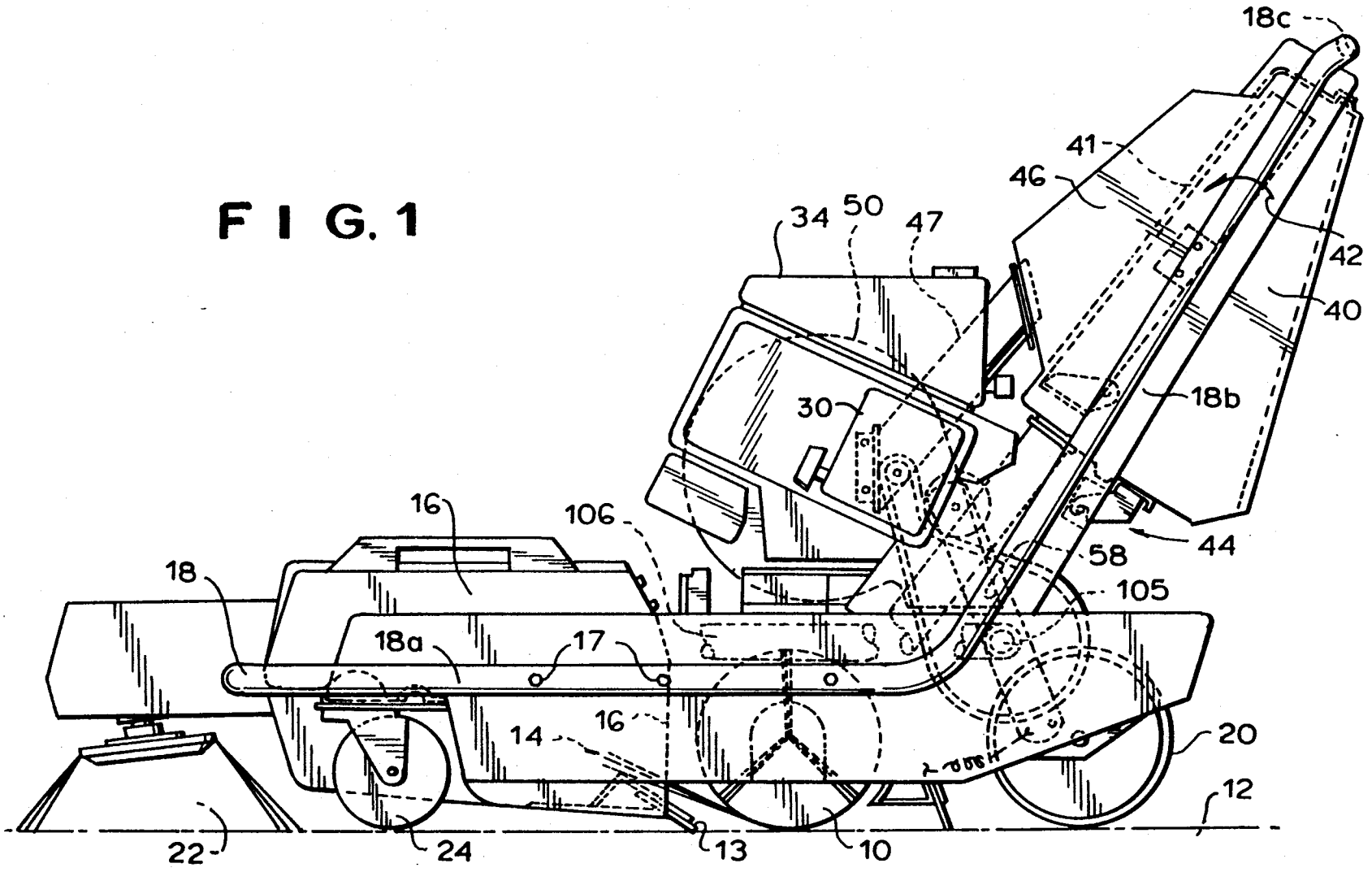
FIG. 1 is a left side elevational view, partially cut away and partially in phantom, of an industrial sweeper according to a preferred embodiment of the invention.

In this description, the terms front, rear, right, left, vertical, horizontal and the like are merely relative terms and are employed to refer to the relative positions of various components in their normal operating position. Throughout the figures, like reference numerals indicate like elements and parts.

Figure 1A:
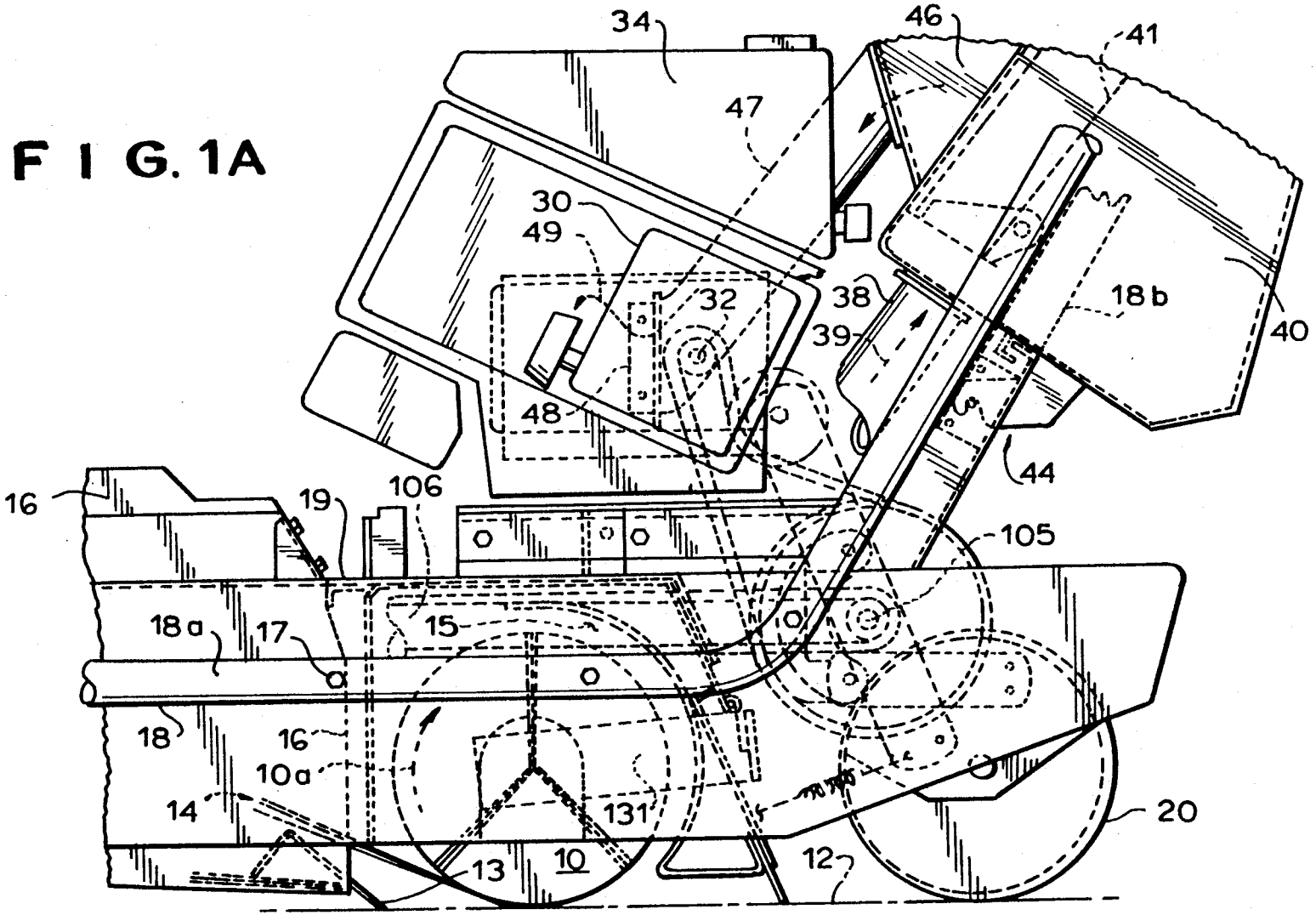
FIG. 1A is an enlarged view of part of FIG. 1.

FIG. 1 is a left side elevational view, partly cut-away and partly in phantom, of an industrial sweeper according to a preferred embodiment of the invention. FIG. 1A is an enlarged view. As shown therein, the sweeper has a main brush 10 which rotates in the direction indicated by the arrow 10*a*, thereby lifting debris, dust and the like, as shown at 14, from the floor 12, and kicking heavier debris forward into a hopper 16. A rubber strip 13, preferably comprising separable finger portions which engage the floor 12, guides the debris 14 into the hopper 16 The hopper 16 is mounted to a frame 19 made of steel sheet or the like, by means of bolts 17 or the like. A perimeter tube 18 has a horizontal portion 18*a* extending to the front of the sweeper and extending horizontally back to behind the main brush 10. From that point, the perimeter tube is curved or extended upward in a rear portion 18*b* which extends toward the rear of the sweeper and at the top has a handlebar 18*c* which is horizontal for being grasped by the operator at a comfortable working height and employed to push or pull the sweeper.

Also shown in FIG. 1 is a rear drive wheel 20. In this embodiment, there is only one rear drive wheel, but more could be added if desired by a simple modification.

Also shown is a side brush 22 which is shown here at the right front corner of the sweeper. A pair of caster wheels are mounted to the frame 18 near the front. Only the caster wheel 24 at the left front corner of the frame is shown here, another such wheel being provided at the right front corner in this embodiment.

An engine 30 provides motive force for the sweeper. The disclosed engine is a small internal-combustion engine. The motor drives a shaft 32 which is shown schematically A fuel tank and associated components are indicated generally at 34. An electrical or other type of engine could also be used.

Figure 2:
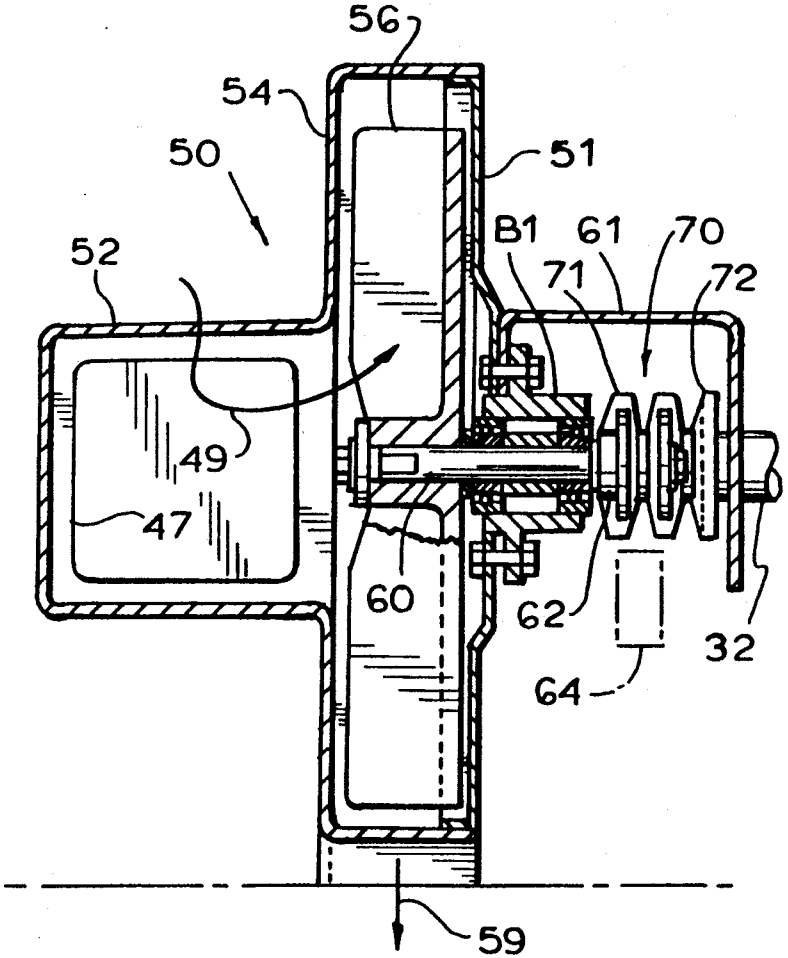
FIGS. 2 and 2A are respectively a cross-section and a side view of the impeller assembly.
Figure 2A:
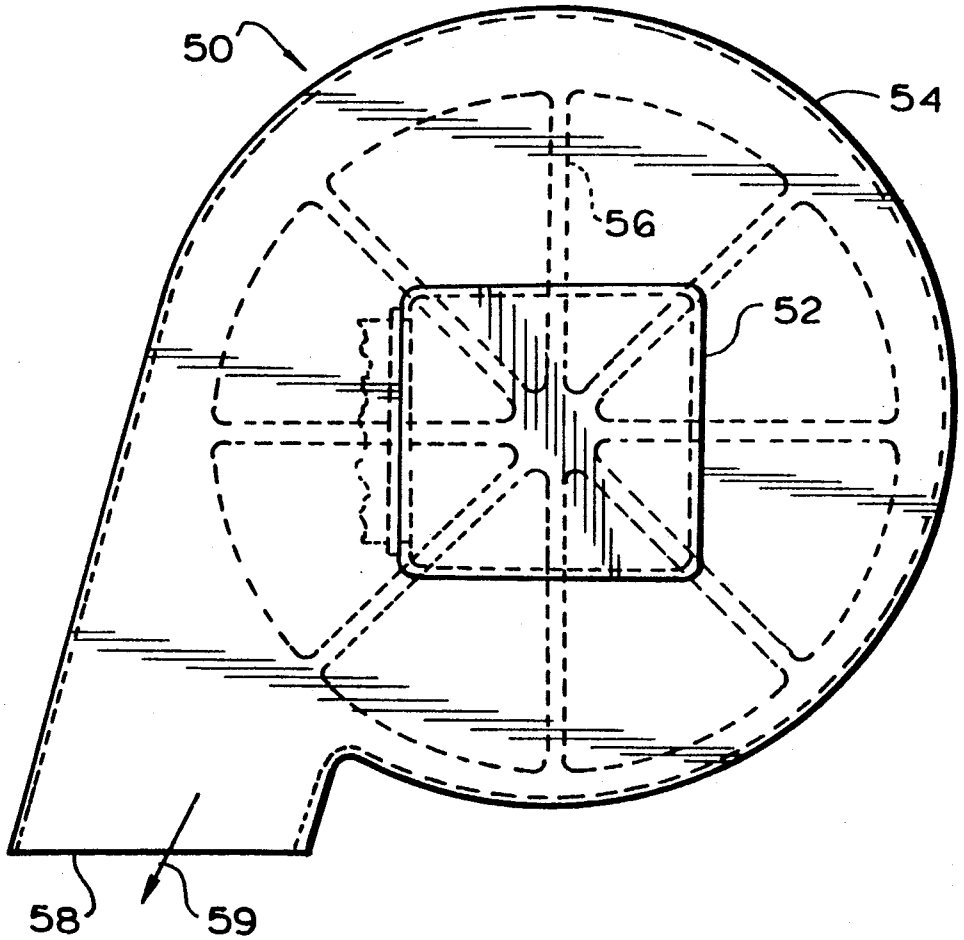

An air filtration system is also shown in FIGS. 1 and 1A. A dust chamber generally defined at 15 surrounds the main brush 10. An intake duct 38 communicates with the dust chamber 15 for drawing dust therefrom as shown by the arrow 39. Dust-laden air passes into a rear filter box 40 where larger dust particles can precipitate. Then the air passes forward through a filter 41 as indicated by the arrow 42 and the remaining dust is removed. The rear filter box 40 can be removed by a slip-hinge arrangement 44 or the like in order to clean or replace the filter 41, and remove precipitated dust from the rear filter box 40. Clean air passes through a front filter box 46 and through an outlet duct 47 which is mounted in this example to a bracket 48. The air passes from the outlet duct 47 into the impeller housing 50 as indicated by the arrow 49. The impeller assembly is shown in FIGS. 2 and 2A. As shown in detail in FIG. 2, the impeller housing comprises an intake portion 52 and a blade portion 54. As indicated by the arrow 49, filtered air exits the outlet duct 47 and goes into the intake portion 52 and is redirected substantially 90° into the rotating fan blades 56. The rotation of the blades 56 forces the clean air out through a fan outlet 58. The clean air exits the sweeper downward and toward the rear as indicated at 59. Further details of the impeller assembly shown in FIG. 2 will be discussed below in connection with the drive system of the sweeper.

Referring again to FIG. 2, the impeller has a shaft 60 supported on a bracket 61 by a bearing B1 and at the other end of the shaft 60 is a pulley 62 for driving the impeller. Seen in the background of FIG. 2, behind the pulley 62, is the engine pulley 70 which is a double pulley comprising a main shaft drive pulley 71 and an impeller drive pulley 72 A fixed idler 64 is shown schematically below the impeller pulley 62, thereby forming a three-pulley support for the V-belt 65 which drives the impeller.

Advantageously, the bracket 61 may be a U-shaped bracket as shown in FIG. 2. On one arm of the U the impeller housing 50 is mounted by its back wall 51, and the impeller bearing B1 is also mounted. The opposite arm of the U of the bracket 61 may be mounted to the engine mounting and the drive shaft 32 from the engine, shown in phantom in FIG. 2, will then pass through the bracket 61 through an appropriate bearing (not shown).

Figure 3:
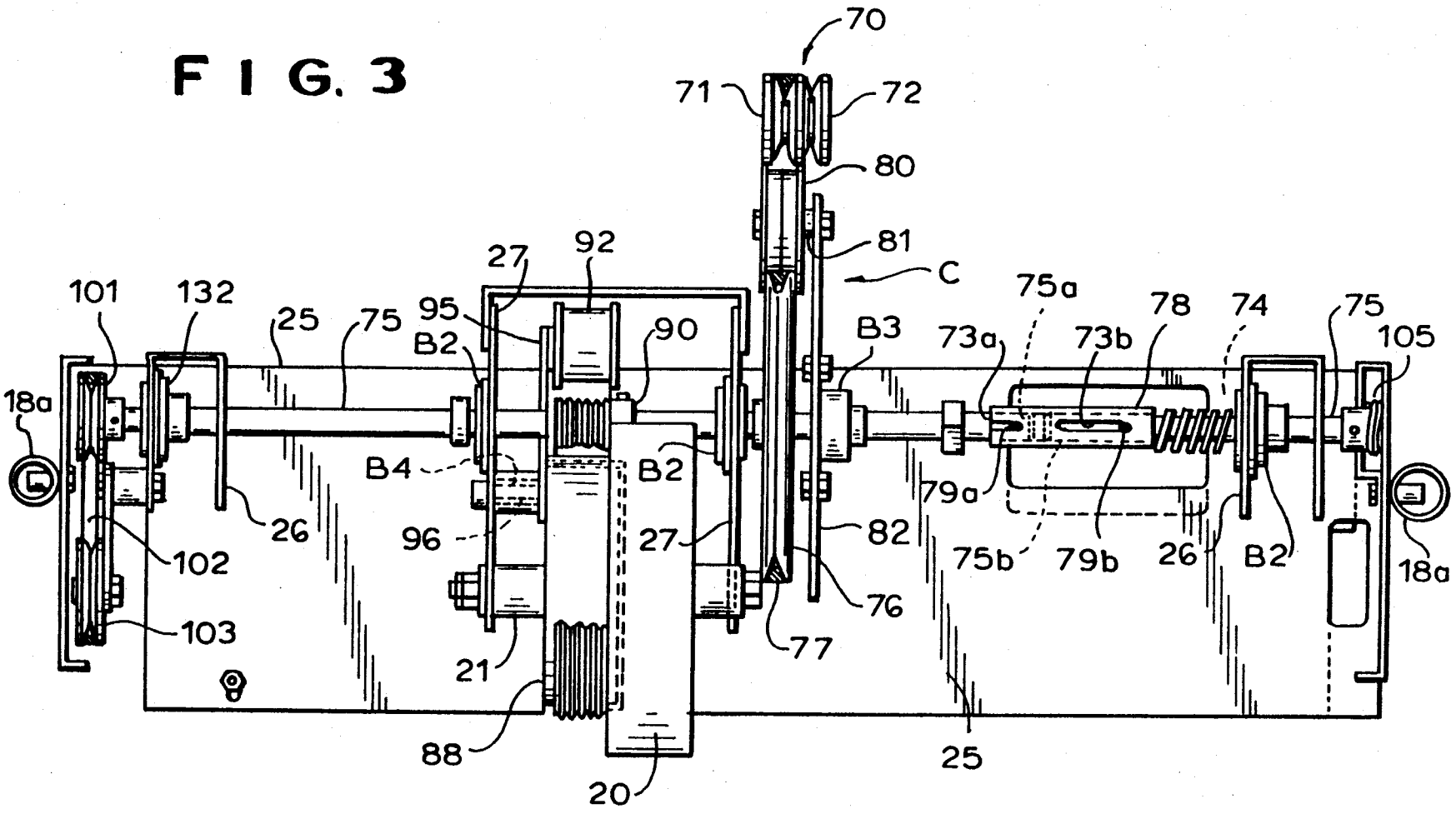
FIG. 3 is a schematic view of the drive arrangement.

A schematic view of the drive layout is shown in FIG. 3. A single main drive shaft 75 drives the drive wheel 20, the main brush 10 and the side brush 22. The main drive shaft 75 is supported on a support wall 25, which forms part of the sweeper frame, by several brackets 26 and webs 27, via bearings B2. The main shaft drive 75 is driven by a drive pulley 76 which is connected by a V-belt 77 to the main drive shaft pulley 71 of the double engine pulley 70. The V-belt 77 is not always tightly engaged upon both pulleys 76 and 71. Because of the inherent stiffness of a conventional V-belt and a substantial slack in the size of the V-belt that is provided, the V-belt will tend to return to a loosened position in which the pulley 71 turns freely but the pulley 76 is not driven.

As mentioned above, the engine pulley 70 runs continuously, always driving the fan impeller via the impeller pulley 72. The drive to the drive shaft drive pulley 76, however, is not continuous, the pulley 76 being driven only when the V-belt 77 is tightened about the pulleys 71 and 76. This tightening is carried out by a clutch pulley 80, which bears against the V-belt 77. In this embodiment, the clutch pulley is an idler with a flat surface for bearing on the outside of the V-belt 77. Alternatively, other forms might be usable, for example, a conventional pulley with a V-shaped surface which would bear against the inside V-shaped surface of the V-belt 77. The present arrangement gives greater leverage, however.

The clutch pulley 80 in this embodiment is an idler which can be shifted to bear against the V-belt 77 and thereby tighten it on the pulleys 71 and 76 when it is desired to drive the main drive shaft 75. Conceivably, it could also be a powered pulley, but this would be more complicated than the illustrated arrangement.

The clutch pulley 80 is mounted by a shaft 81 to a clutch plate 82. In this embodiment, the clutch plate 82 is mounted pivotably about the main drive shaft 75 by a bearing B3. However, a different pivot point could be provided for the clutch plate 82.

Figure 4:
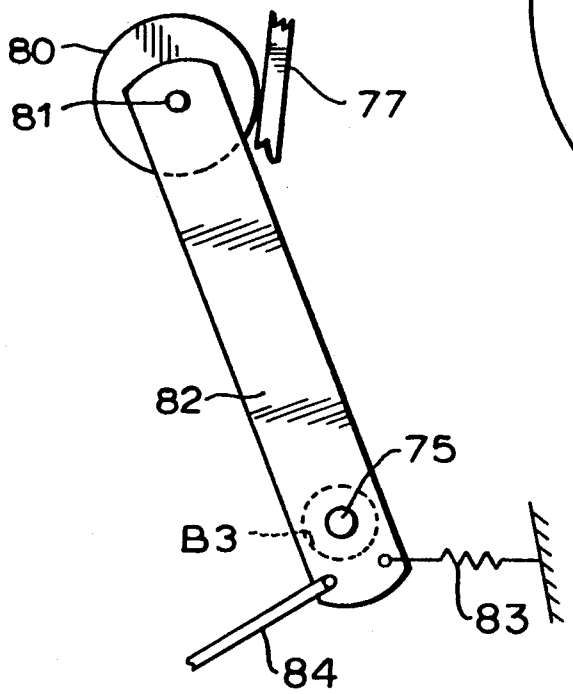
FIG. 4 is a schematic view of the clutch plate.

A simplified side view of the clutch plate 82, as seen from the direction C in FIG. 3, is presented in FIG. 4. The clutch pulley 80 is biased away from the V-belt, toward the left in FIG. 4, by a tension spring 83 which is connected between the clutch plate 82, below its pivot point, and the support wall 25. A cable 84 attached to a handgrip on the handlebar 18*c* (not shown) is provided to pull the lower portion of the clutch plate 82 toward the left, thereby pivoting the clutch pulley 80 toward the right and tensioning the V-belt 77. Thus, the V-belt 77 is selectively tensioned under the control of the operator via the cable 84, thereby selectively driving the main drive shaft 75.

Figure 5:
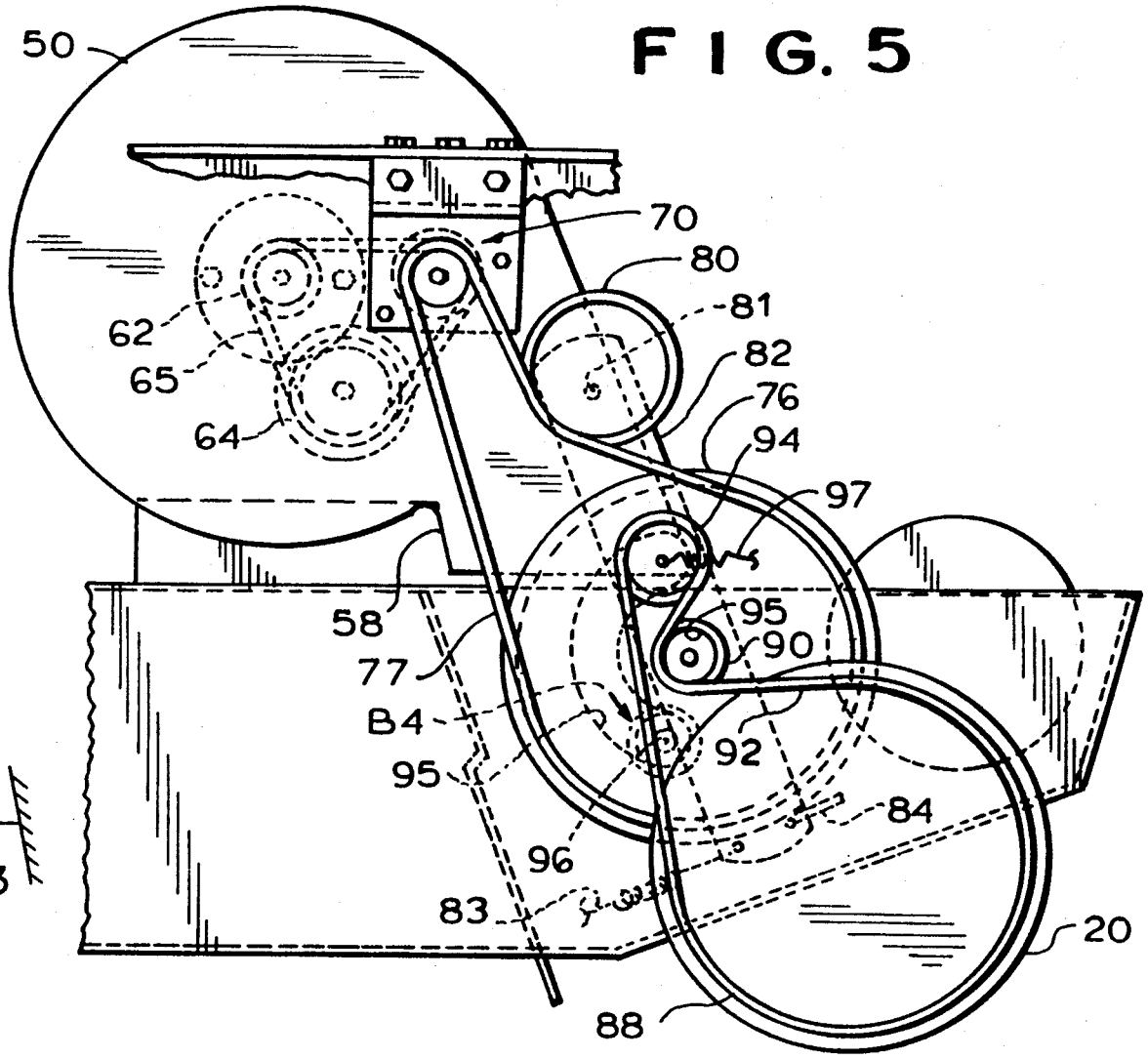
FIG. 5 is a schematic side view showing part of the drive arrangement of FIG. 3.

Referring again to FIG. 3, the drive wheel 20 is mounted to a pair of webs 27 by a shaft 21. Also mounted on the shaft 21 and permanently fixed to the drive wheel 20 is a smooth drum drive pulley 88. The pulley 88 is driven by a poly-V-belt ground drive pulley 90 on the main drive shaft 75. The poly-V-belt 92 (FIG. 5) is kept taut by an idler 94 The idler 94 may be of any conventional construction, preferably smooth. The pulleys 88 and 94 engage the smooth back side of the poly-V-belt 92 In this embodiment, for the greatest leverage, as best seen in FIG. 5, it is mounted to the upper end of a C-shaped plate 95, the lower end of which is pivoted about a shaft 96 by an appropriate bearing B4, below the driveshaft 75. The plate 95 on which the idler 94 is mounted is biased into a position substantially above the drive shaft 75 by a tension spring 97, shown schematically.

As an alternative, the main engine pulley 70 (FIG. 3) could comprise more than two pulleys. For example, it could include a third pulley and separate V-belts could be provided to drive the drive wheel 20 and the main brush 10. In that case, each V-belt could be provided with a respective clutch pulley actuated by a separate hand grip and cable. As another alternative, the engine pulley 70 might not be mounted directly on the engine shaft, but might be driven by a fourth pulley which receives power from an engine or electric motor over an additional belt.

Another advantageous feature of the main drive shaft 75 is shown in FIG. 3. The V-belt 77 will require replacement when it is worn out. In prior sweepers, replacing the belt 77 has required a time-consuming and difficult removal of the drive shaft 75 from its mountings so the V-belt could be placed around it. To avoid this, according to this feature, the main shaft is formed as a combination of a pair of partial shafts 75*a*, 75*b* as shown toward the right-hand side in FIG. 3. A sleeve 78 engages the shafts 75*a*, 75*b* via at least a pair of respective pins 79*a*, 79*b*. The sleeve 78 is biased toward the left as seen in FIG. 3 by a compression spring 74. The pin 79*b* mounted on the right-hand main shaft portion 75*b* engages a closed slot 73*b* in the sleeve 78. A slot 73*a* engages the pin 79*a* on the left-hand main shaft portion 75*a*. The sleeve 78 can be moved toward the right against the force of the spring 74 and because the slot 73*a* is open, can be moved toward the right completely off the shaft portion 75*a* and onto the portion 75*b*. This exposes the gap defined between the separate shaft portions 75*a* and 75*b*. The V-belt can be inserted through that gap, thereby locating the V-belt around the shaft 75 without having to remove the shaft 75 from its mountings.

The main brush is driven by a main brush drive pulley 101 at one end of the shaft 75 (FIG. 3), via a V-belt 102 which is tensioned by an idler 103. The side brush is driven by a side brush drive pulley 105 at the other end of the main drive shaft 75, which is a poly-V-pulley in this embodiment.

Figure 6:
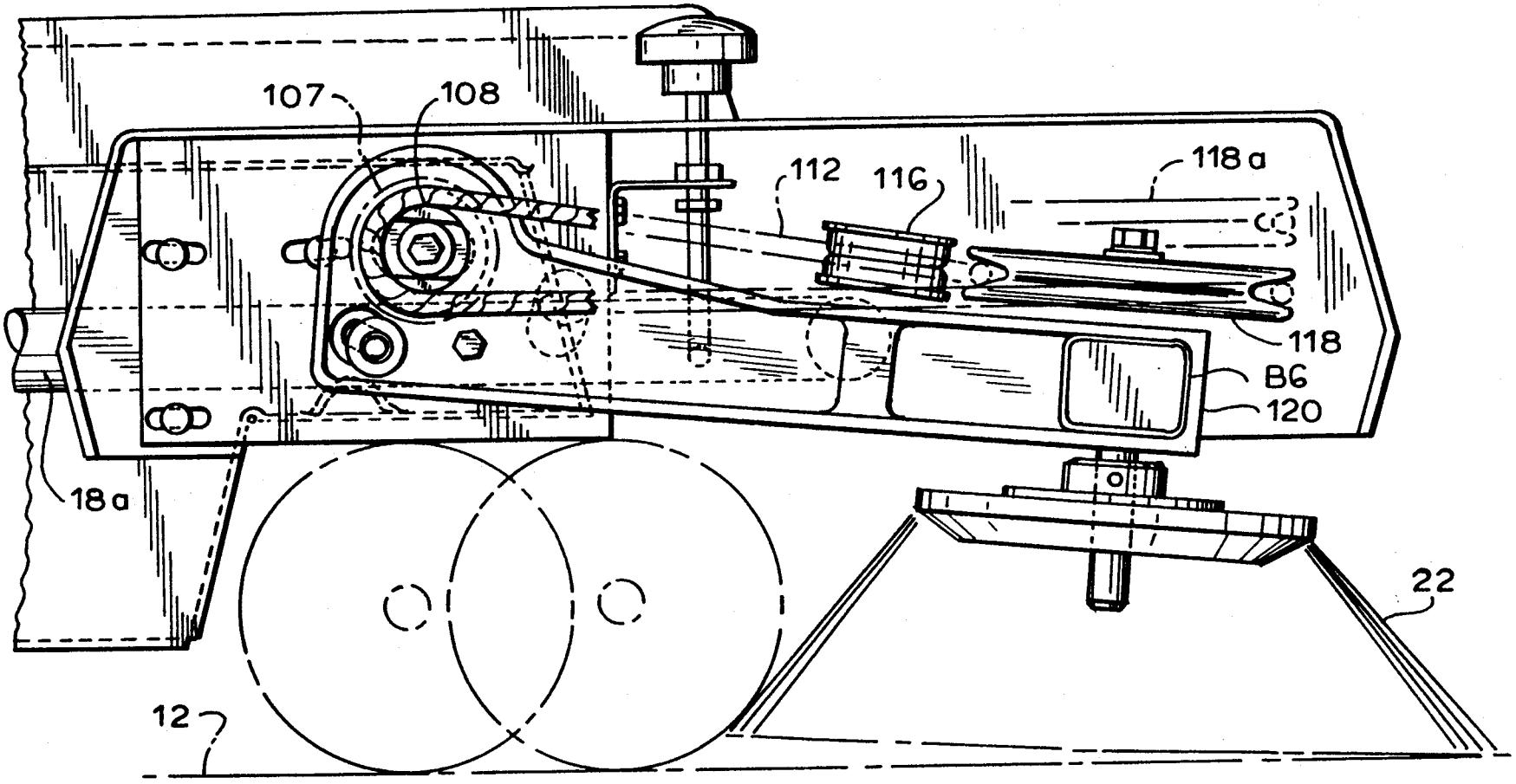
FIG. 6 is a schematic view showing the drive for the side brush.
Figure 7:
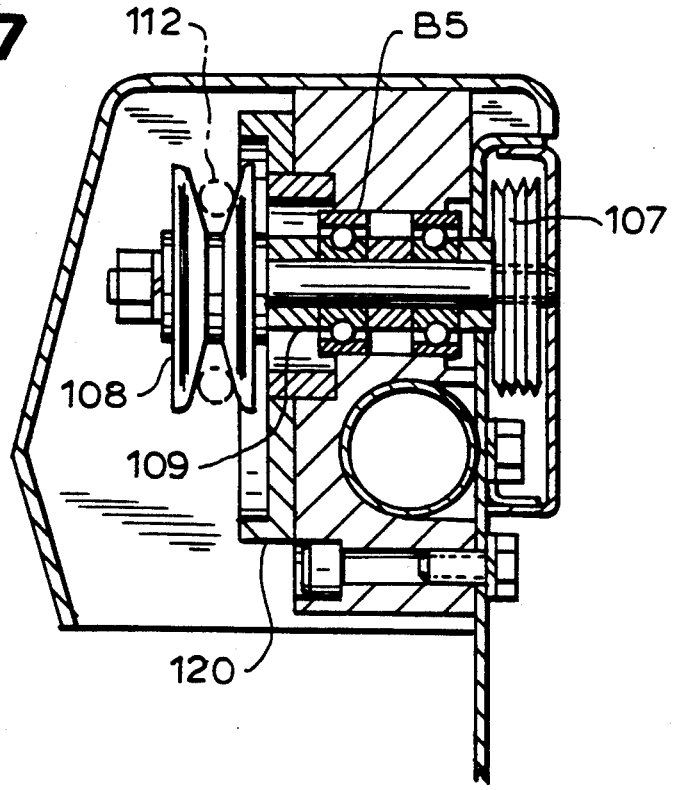
FIG. 7 is a cross-sectional detailed view corresponding to a portion of FIG. 6.
Figures 8, 14, 14A:
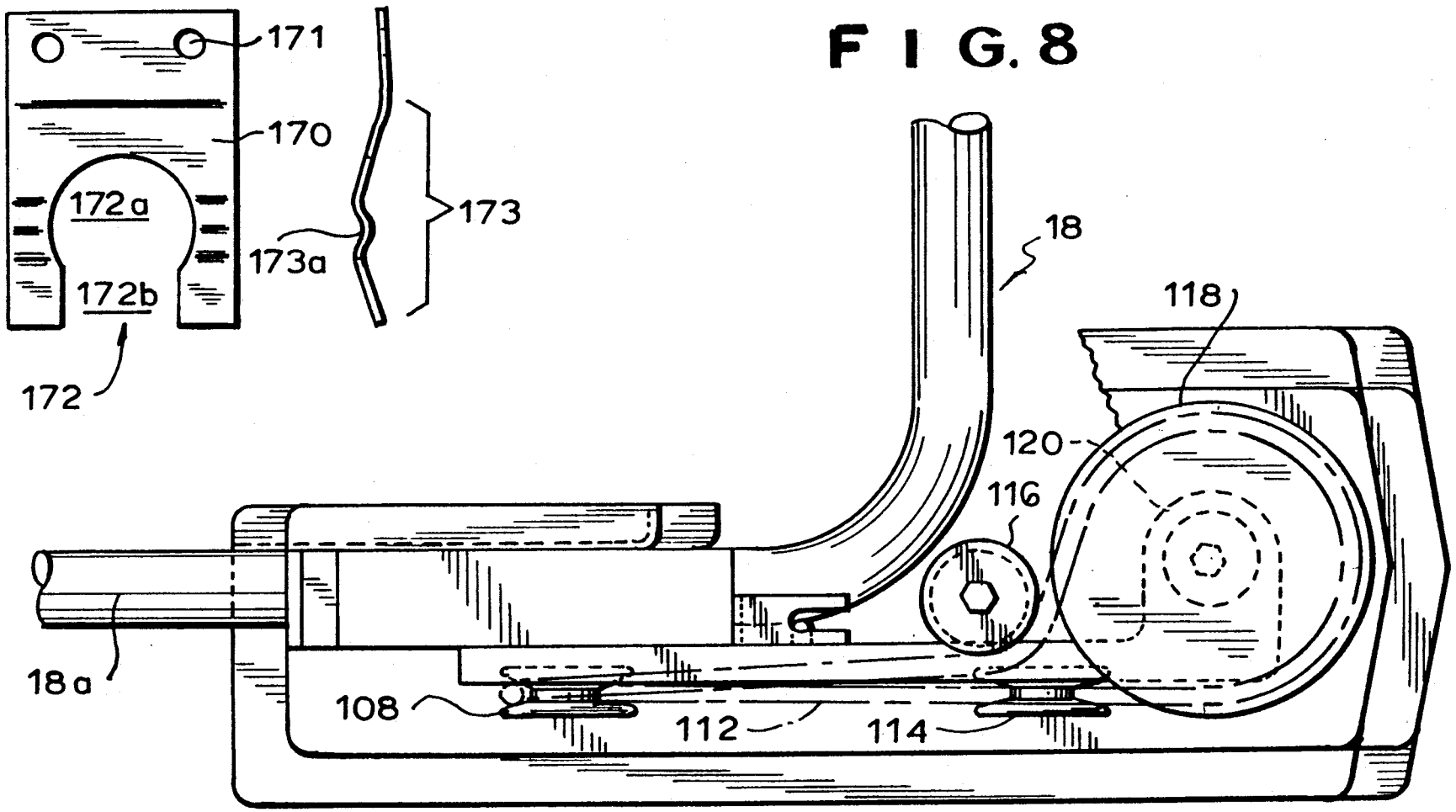
FIG. 8 is a schematic top view corresponding to FIG. 6.
FIGS. 14 and 14A are respectively a plan view and a side view of an alternate type of spring that can be used with the mounting arrangement of FIG. 13.

The drive of the side brush is shown in FIGS. 6, 7 and 8. The side brush drive pulley 105 drives a poly-V-belt 106 which in turn drives a first vertical parallel pulley 107 which is mounted on the frame of the sweeper toward the right-hand front corner. A second vertical parallel pulley 108 is mounted to rotate with the first parallel pulley 107 by a shaft 109 which is supported on the frame of the sweeper by an appropriate bearing B5. The second parallel pulley 108 drives a belt 112 which advantageously is a twistable O-ring belt. The belt 112 is supported by a vertical idler 114 (FIG. 8) and a horizontal idler 116. Between the idlers 114 and 116 the belt 112 is trained about the side brush pulley 118 which is horizontal.

The side brush 22 is driven by the side brush pulley 118 via a shaft 119 on an appropriate bearing B6. Advantageously, the brush 22 and the pulleys 114, 116, 118 are all mounted on a floating bracket 120 which may be pivotably mounted for pivoting in a vertical plane about the shaft 109. Thus supported, the brush 22 can rise or fall to a limited extent, as shown in phantom at 118*a* in FIG. 6, to adjust to irregularities or obstacles on the surface of the floor 12.

Figure 7A:
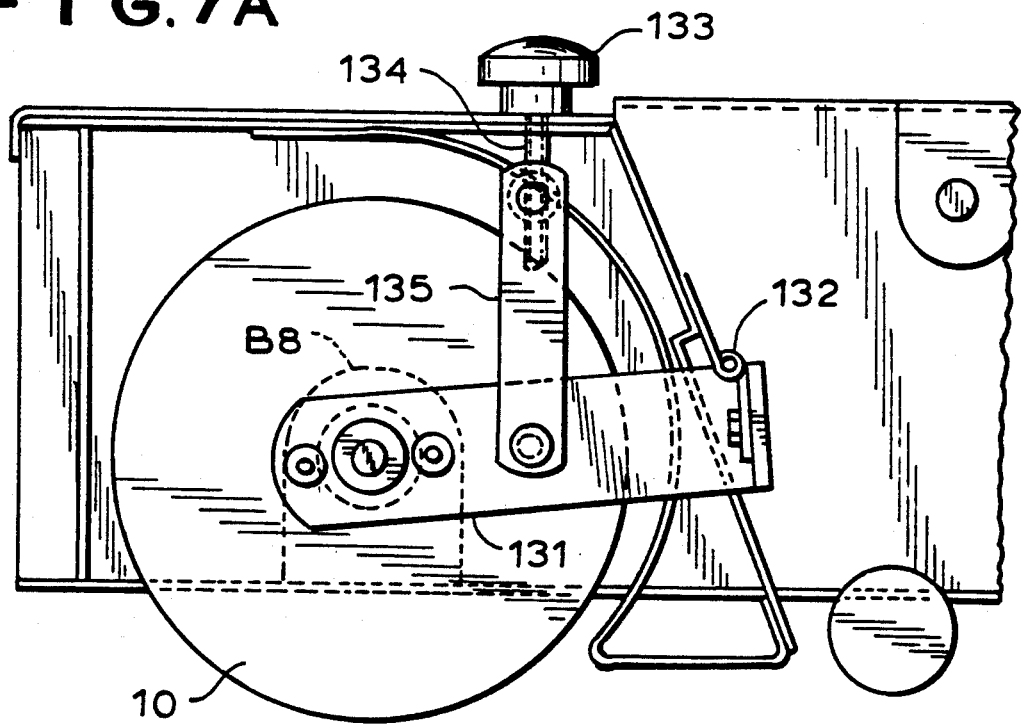
FIG. 7A is a side view of an arrangement for supporting one end of the main brush.

A drive and support arrangement for the main brush will now be described. The main brush 10 has a tubular core 130 and is supported by a bearing B7 at the first end of the brush and a bearing B8 at the second end of the brush. The second bearing B8 is mounted on a tiltable bracket 131 on the left side of the sweeper, as shown in FIG. 7A. The bracket 131 pivots in a vertical plane about a hinge 132 permanently mounted on the frame of the sweeper, whereby the brush can be lifted or lowered A knob 133 has a depending shaft 134 which is threaded and engages a threaded portion of a link 135. Thus, by turning the knob, the bracket 131 and with it the bearing B8 can be raised and lowered.

The bearing B8 supports a shaft 136 (FIG. 8A) which supports and drives the second end of the brush 10. At the outside of the frame, on the left side of the sweeper, is secured a drive pulley 140. The pulley 140 is connected by an appropriate V-belt to the pulleys 101, 103 (FIG. 3) for driving the main brush.

The bearing B8 comprises a bearing cap B8*a*, a washer B8*b*, a bearing B8*c*, a spacer B8*d* and a pair of ball bearing assemblies.

A highly advantageous mandrel 142 is formed on the inside of the bearing B8, within the frame of the sweeper, for engaging the second end of the brush core 130.

The mandrel 142 is secured to the shaft 136, for example by welding. As shown in detail in FIGS. 9 and 9A, the mandrel is generally cylindrical, but its radially peripheral surface 142*a* is barrel-shaped, that is, forms the shape of part of a sphere centered about the axis of the cylinder. A pair of collinear, diametrically opposite guide pins 144 extend from opposite portions of the peripheral surface 142*a*. The mandrel 142 has a diameter A which is sized to fit into the hollow center 130*a* of the brush core 130. A pair of corresponding grooves corresponding to the upstanding guide pins 144 are formed in the end of the mounting core 130. The grooves 145 engage these guide pins for allowing the brush tube 130 to be positively driven by the shaft 136.

Figure 8A:
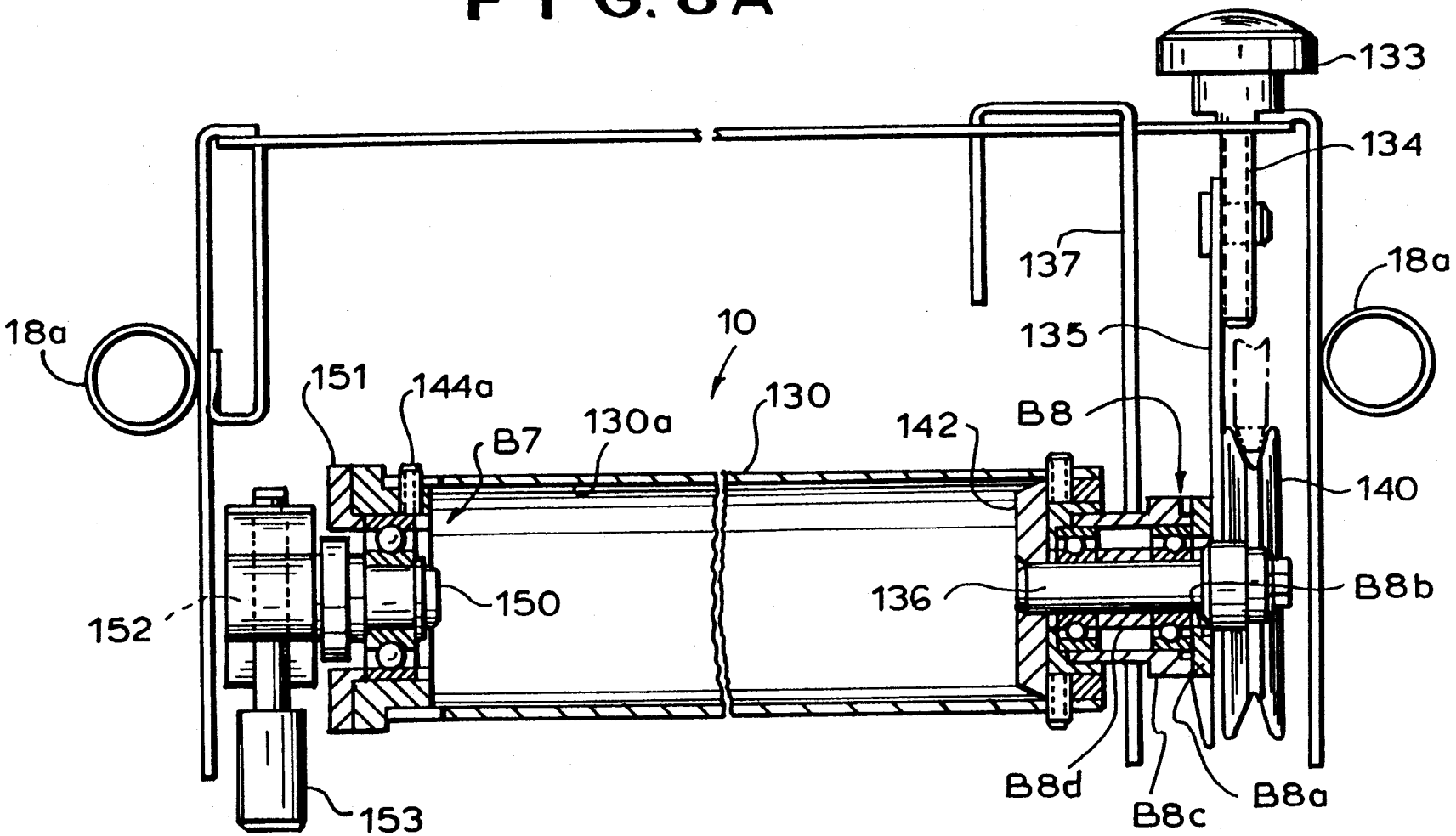
Figure 15:
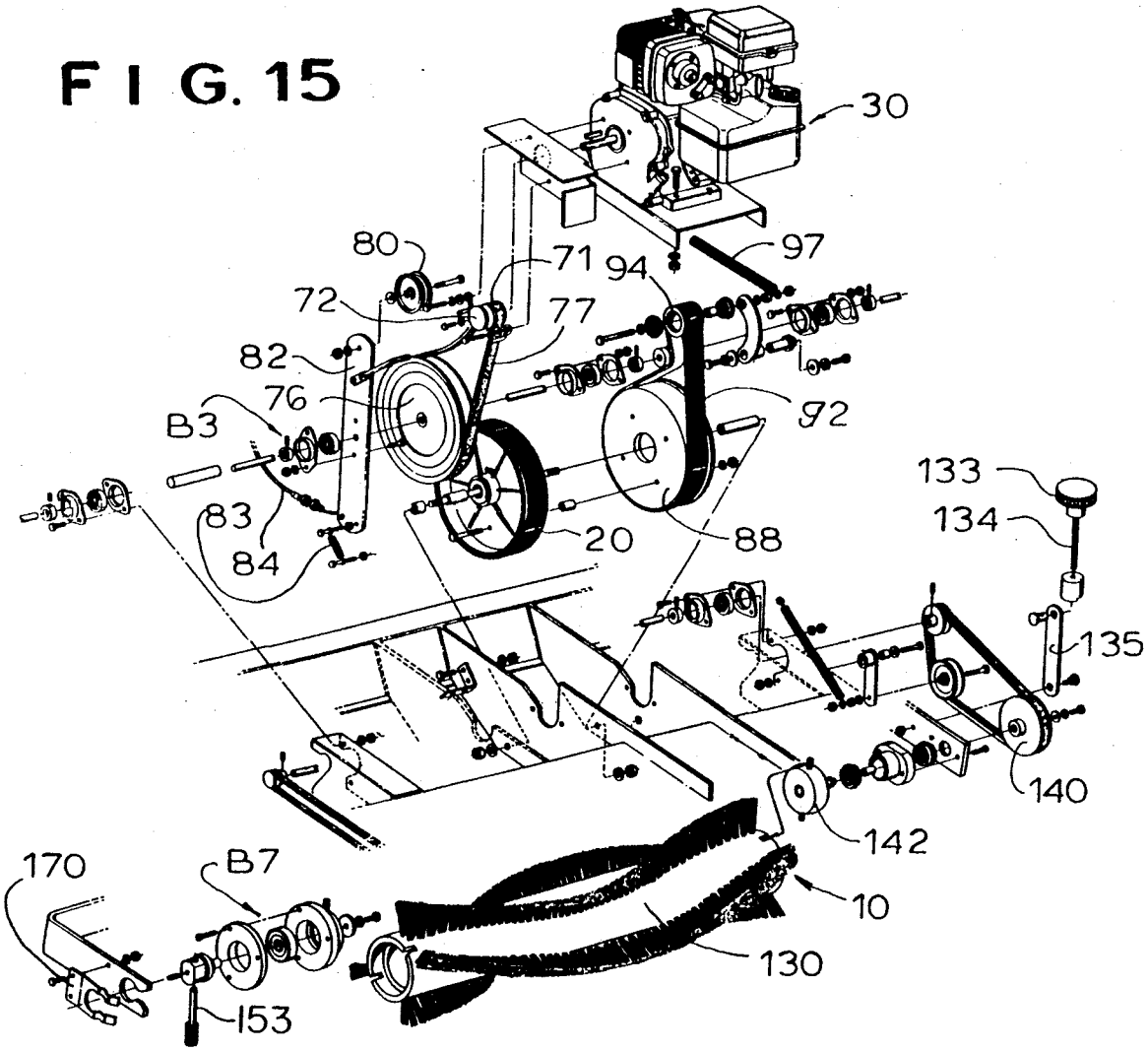
FIG. 15 is an exploded view illustrating the drive components for the main drive wheel and the main brush.

As seen in FIG. 8A, the arrangement places the mandrel a certain distance away from the side wall of the sweeper frame on which the bearing B8 is mounted. In view of this spacing, and because of the spherically curved surface 142*a*, the brush core can be easily pivoted by a small angle for being simply removed from the mandrel by being drawn off the mandrel. The guide pin 144 easily slips from the groove 145, as shown schematically in FIG. 10. Thereby, the brush tube 130 can be easily removed from its mounting bearing B8 without requiring any excessive lateral space to be taken up by the mounting and removal arrangement.

In FIG. 10, as seen from above, the brush core 130 is shown in solid lines in the operating position. In the position shown in phantom, designated 130*a*, it has been rotated by about 20° toward the front of the sweeper. Its left front corner, indicated at 130*b*, has moved toward the frame portion designated 137 but has not contacted it. Thus, the brush core 130 is free to pivot far enough to be removed from the mandrel 142 by a simple rotation, with substantially no lateral movement away from the mandrel being required.

FIG. 11 is a top view showing the first end of the brush core 130 in solid lines. At 130*a* the brush tube is shown after having been rotated about 20° as just discussed. The core 130 is supported at its first end by a brush idler B7 which comprises a central shaft 150, an outer bearing cup 151 and a ball bearing assembly in between. The bearing cup has at least one guide pin 144*a* extending radially therefrom. The bearing cup is sized to fit closely in the hollow center 130*a* of the brush core 130 with the guide pin 144*a* engaging one of the grooves 145. Thus, both the ends of the brush tube 130 may be identical and the brush tube can be reversed if desired and will still cooperate with the respective bearings at its first and second ends.

The engagement of the brush idler B7 and the brush tube 130 is shown in perspective view in FIG. 11A. An outer shaft 152 which is integral with the bearing cup 151 is substantially cylindrical in cross-section, but has parallel flat top and bottom surfaces 152*a*. Parallel to these flat surfaces 152*a* is a locking pin 153.

FIGS. 12 and 12A show vertical and horizontal cross-sections, respectively, of a bail arm extension 160 on the sweeper frame, having an aperture 161 toward the front of the sweeper. The interior portion 161*a* of the aperture is generally circular in cross-section. Its entrance passage 161*b* between the circular portion 161*a* and the front of the extension 160 has flat top and bottom surfaces and its vertical dimension is somewhat less than the diameter of the circular area 161*a*. As shown in FIGS. 12 and 12A, an interior space 161*c* is formed between the lateral sides of the extension 160 and extends from below the center of the circular aperature 161*a* to the top of the extension 160. It also extends from a point spaced behind the circular aperature 161*a*, by at least the length of the tip 153*a* of the locking pin 153, to a point somewhat forward of the center of the circular portion 161*a*.

FIG. 13 is a side view, partly in cross-section, showing the position of the outer shaft 152 of the brush idler shaft 150, and the locking pin 153, after insertion into the bail arm extension 160. The view in FIG. 13 corresponds to the view with the brush tube 130 in working position, as shown in solid lines in FIG. 11. The outer shaft 152 is initially inserted into the bail arm extension 160 in the position shown schematically in FIG. 11A, that is, with the locking pin 153 and the flat surfaces 152*a* horizontal. The flat surfaces 152*a* correspond to the flat top and bottom surfaces of the entrance aperture 161*b*, whereby the outer shaft 152 can enter into the circular aperture 161*a*. Then the outer shaft 152 is rotated clockwise as seen in FIG. 13, so its cylindrical surfaces engage the circular aperture 161*a* and can no longer be removed. The locking pin is permitted to rotate by the apertures 161*c* which accommodates the tip 153*a* of the locking pin, and the aperture 161*d* which permits the handle of the locking pin to rotate. Because the cylindrical surfaces of the outer shaft 152 and the aperture 161*a* are engaged and are larger than the vertical dimension of the aperture 161*b*, the outer shaft can no longer be removed from the bail arm extension 160.

Thus the brush tube 130, which has been fitted to the brush idler B7, as shown in FIG. 12, can easily be inserted and locked into the bail arm extension 160 at the first end of the brush 10.

The locking pin 153 is held in this position by a flat spring 155 mounted on top of the bail arm extension 160 The spring 155 has a hole above the center of the circular aperture 161*a*. As the locking pin 153 is being rotated clockwise into the position shown in FIG. 13, with the tip 153*a* vertical, the tip 153*a* displaces the spring into the position shown in phantom at 155*a*. When the tip 153*a* reaches that position, the tip 153*a* engages the hole in the spring 155, and the spring snaps back down to the position shown in solid lines in FIG. 3, locking the tip 153*a* in position.

FIG. 14 is a plan view and FIG. 14A is a side view of an alternate spring 170. This spring is attached by a pair of mounting holes 171 to a suitable substantially vertical support, with its aperture 172 facing the front of the sweeper. The aperture 172 has a circular portion 172*a* and an entrance portion 172*b* that are analogous to those discussed in connection with FIGS. 12, 12A, above. The spring is deformed to have a convex portion 173 which surrounds the center of the circular portion 172*a*. The shaft 152 can be inserted into the aperture 172 until it contacts the back of the circular portion 172*a*. During the insertion, the locking pin 153 is kept generally to the left of, but close to, the spring as shown in FIG. 14A. After insertion, the locking pin is rotated so that it is vertical and engages a detent 173*a*, thereby holding the locking pin in its vertical position with the shaft 152 retained within the circular portion 172*a* of the aperture 172. With this embodiment, the brush idler B7 can be retained by an extremely simple spring arrangement, eliminating the necessity for the machined bail arm extension shown in FIGS. 12 and 12A.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A surface sweeping machine comprising:

a frame which defines a front and back and two sides of the machine;

a plurality of wheels mounted on the frame which support the machine on said surface, at least one of said wheels being a drive wheel;

a motor mounted on the frame; first pulley means connected to said motor for delivering motive force produced by said motor;

second pulley means connected to said drive wheel for receiving motive force for driving said machine;

a main brush mounted in the frame for rotation about a transverse axis and engaging said surface in order to sweep said surface; third pulley means connected to said brush for receiving motive force for rotating said brush;

connecting means interconnecting said first, second, and third pulley means for transferring motive forces from said motor to drive said wheel and main brush simultaneously, said connecting means including engaging means having an engaged condition in which neither said drive wheel nor said main brush is driven and a disengaged condition in which said drive wheel and main brush are both driven; and clutch means on said frame for selectively placing said engaging means in said engaged and disengaged conditions under operator control.

2. A machine as in claim 1, wherein said engaging means includes a drive belt interconnecting said first pulley means with said second and third pulley means, and said engaged and disengaged conditions of said engaging means correspond respectively to tightened and loosened conditions of said drive belt, and said clutch means comprises a clutch pulley, and means for mounting said clutch pulley on said frame for being shiftable into and out of an engaged position in which said clutch pulley bears on said drive belt and thereby places said drive belt in said tightened condition.

3. A machine as in claim 2, wherein said drive belt has inherent stiffness whereby it spontaneously returns to its loosened condition when said clutch pulley is out of its engaged position.

4. A machine as in claim 2, wherein said clutch pulley is mounted on a clutch plate and is pivoted into said engaged position by pivoting said clutch plate about a pivot point.

5. A machine as in claim 4, wherein said connecting means includes a drive shaft on which said second and third pulley means are mounted; and wherein said clutch plate is pivotable about said drive shaft.

6. A machine as in claim 2, further comprising a tension spring which biases the clutch pulley away from said drive belt, and operator-controllable means which urges said clutch pulley into engagement with said drive belt.

7. A machine as in claim 2, wherein said connecting means includes a drive shaft on which said second and third pulley means are mounted, and wherein said drive belt drivingly interconnects said motor and said first pulley means when said drive belt is in said tightened condition.

8. A machine as in claim 7, wherein said clutch pulley is mounted for being pivotally movable about said drive shaft into said engaged position for tightening said drive belt.

9. A surface sweeping machine comprising:

a frame which defines a front and back, and two sides of the machine;

a plurality of wheels mounted on the frame which support the machine on said surface, at least one of said wheels being a drive wheel;

a motor mounted on the frame;

a main brush mounted in the frame for rotation about a transverse axis and engaging said surface in order to sweep said surface;

connecting means interconnecting said motor, said drive wheel, and said main brush for rotating said main brush and driving said sweeping machine;

said connecting means including a drive shaft and a pulley on the drive shaft; and a drive belt connected to said motor and said pulley thereby permitting said motor to drive said drive shaft;

drive shaft mounting means on said frame for rotatably supporting said drive shaft; and said drive shaft having first and second drive shaft parts and a gap therebetween; and means for selectively connecting said first and second parts across said gap for forming a continuous drive shaft, and for exposing said gap for permitting said drive belt to be placed around said drive shaft without removing said drive shaft from said drive shaft mounting means.

10. A machine as in claim 9, wherein said means for selectively connecting said first and second drive shaft parts across said gap comprises a sleeve secured at an end of said first drive shaft part and slidable thereon so as to engage a proximal end of said second drive shaft part.

11. A machine as in claim 10, further comprising spring means for biasing said sleeve toward said second drive shaft part.

12. A machine as in claim 10, further comprising securing means on said first and second driveshaft parts for rotationally securing said sleeve in position with respect to said first and second driveshaft parts.

13. A surface sweeping machine comprising:

a frame which defines a front and back, and two sides of the machine;

a plurality of wheels mounted on the frame which support the machine on said surface, at least one of said wheels being a drive wheel;

a motor mounted on the frame;

a main brush mounted in the frame for rotation about a transverse axis and engaging said surface in order to sweep said surface;

connecting means interconnecting said motor, said drive wheel, and said main brush for rotating said main brush and driving said sweeping machine;

further comprising first and second brush bearings located respectively on first and second sides of said frame for rotatably supporting said brush at first and second ends thereof;

each of said ends of said brush having engaging means for positively engaging said first and second brush bearings; and wherein:

said first brush bearing is lockable on said frame by a locking device and is removable from said frame by unlocking said locking device and moving said first brush bearing substantially in the frontward direction; and said second brush bearing includes a generally cylindrical mandrel with a peripheral surface of curved cross-section, structured to be insertable into said second end of said brush and permitting pivoting of said brush about a pivot point on said second brush bearing in a horizontal plane, substantially in the frontward direction, wherein the second brush bearing is spaced from said frame, and said pivoting brings a portion of said brush into a location between said second brush bearing and said frame;

whereby said brush is removable from said frame by unlocking said locking device, and removing said first brush bearing from said frame, while pivoting said brush about said pivot point on said second brush bearing.

14. A machine as in claim 13, wherein said generally cylindrical mandrel has a flangeless, barrel-shaped peripheral surface.

15. A machine as in claim 14, further comprising means on said second brush bearing for receiving motive force from said connecting means for rotating said brush.

16. A machine as in claim 13, further comprising means on said second brush bearing for receiving motive force from said connecting means for rotating said brush.

17. A machine as in claim 13, wherein said locking device on said first brush bearing has an unlocked position in which it is freely engageable into and releasable from a portion of said frame, and a locked position in which it is secured to said frame.

18. A machine as in claim 1, further comprising suction means including a fan for applying suction to material raised from said surface by said main brush; and wherein said first pulley means comprises a pair of pulleys shaft-mounted to said motor, one of said pulleys being connected by a drive belt of said engaging means to said second pulley means, and the other pulley being connected by a fan belt to said fan.

19. A machine as in claim 18, wherein said fan is driven continuously by said motor.

20. A machine as in claim 1, wherein said connecting means includes a drive shaft on which said second and third pulley means are mounted, whereby said main brush is driven substantially simultaneously with said drive wheel.

21. A surface sweeping machine comprising:

a frame which defines a front and back, and two sides of the machine;

a plurality of wheels mounted on the frame which support the machine on said surface, at least one of said wheels being a drive wheel;

a motor mounted on the frame;

a main brush mounted in the frame for rotation about a transverse axis and engaging said surface in order to sweep said surface;

connecting means interconnecting said motor, said drive wheel, and said main brush for rotating said main brush and driving said sweeping machine;

further comprising first and second brush bearings located respectively on first and second sides of said frame for rotatably supporting said brush at first and second ends thereof;

each of said ends of said brush having engaging means for positively engaging said first and second brush bearings; and wherein:

said first brush bearing is lockable on said frame by a locking device and is removable from said frame by unlocking said locking device and moving said first brush bearing substantially in the frontward direction; and said second brush bearing has means permitting said brush core to pivot thereabout in a horizontal plane, substantially in the frontward direction, with substantially no sideways movement;

whereby said brush is removable from said frame by unlocking said locking device, and removing said first brush bearing from said frame, while pivoting said brush about said means on said second brush bearing;

wherein said locking device on said first brush bearing has an unlocked position in which it is freely engageable into and releasable from a portion of said frame, and a locked position in which it is secured to said frame;

wherein said frame has a forked extension with a forward-facing aperture for receiving said locking device; said aperture being vertically narrower at a front end thereof; said locking device having a first vertical dimension when in its unlocked position whereby it can pass through said front end of said aperture into a back portion thereof, and having a larger second vertical dimension when in its locked position whereby it cannot pass through said front end of said aperture and is thereby secured in said back portion of said aperture.

22. A machine as in claim 21, wherein said frame extension has spring means adjacent said back portion of said aperture for resiliently engaging and retaining said locking device therein.

23. A machine as in claim 22, wherein said locking device has a locking pin, and said spring means engages said locking pin.

24. A machine as in claim 23, wherein said frame extension has a horizontal surface with an aperture through which said locking pin projects in said locked position, and said spring means overlaps a portion of said horizontal surface so as to engage said locking pin in said locked position.

25. A machine as in claim 23, wherein said frame extension and spring means have respective vertical surfaces which are alongside said locking pin in said locked position, and said spring means overlays a portion of said vertical surface of said frame extension so as to engage said locking pin in said locked position.

26. A surface sweeping machine comprising:

a frame which defines a front and back, and two sides of the machine;

a plurality of wheels mounted on the frame which support the machine on said surface, at least one of said wheels being a drive wheel;

a motor mounted on the frame;

a main brush mounted in the frame for rotation about a transverse axis and engaging said surface in order to sweep said surface;

connecting means interconnecting said motor, said main brush and said drive wheel for driving said main brush and said sweeping machine;

said connecting means comprising a drive shaft mounted on the frame and a pulley on the drive shaft; and a drive belt connected to said pulley and said motor thereby permitting said motor to drive said drive shaft;

said drive shaft having first and second drive shaft parts and a gap therebetween; and means for selectively connecting said first and second parts across said gap in order to form a continuous drive shaft, and for exposing said gap in order to permit said drive belt to be placed around said drive shaft without removing said drive shaft from said frame.

* * * * *